United States Patent [19]

Klunder

[11] 4,188,683

[45] Feb. 19, 1980

[54] DRIVE UNIT FOR A SEWER AUGERING MACHINE

[76] Inventor: Horst Klünder, Albert Schweizer Strasse 52, 6000 Frankfurt am Main, Fed. Rep. of Germany

[21] Appl. No.: 889,045

[22] Filed: Mar. 22, 1978

[30] Foreign Application Priority Data

Mar. 30, 1977 [DE] Fed. Rep. of Germany ..... 2714124

[51] Int. Cl.[2] ..... B08B 9/02

[52] U.S. Cl. ..... 15/104.3 SN; 279/60

[58] Field of Search ..... 279/60, 9 R, 64, 65, 279/74; 15/104.3 SN

[56] References Cited

U.S. PATENT DOCUMENTS 3,449,782 6/1969 Hunt ..... 15/104.3 SN 3,457,580 7/1969 Meyers ..... 15/104.3 SN

FOREIGN PATENT DOCUMENTS 959540 3/1950 France ..... 279/60

*Primary Examiner*—Gil Weidenfeld

*Attorney, Agent, or Firm*—Schmidt, Johnson, Hovey & Williams

[57] ABSTRACT

A drive unit for a pipe cleaning or sewer augering machine includes a chuck for the flexible shaft or plumber's snake of the pipe cleaning machine, the chuck having jaws for detachably clamping the flexible shaft to the chuck which, in turn, also transmits driving torque to the flexible shaft and which is operably connected to the driving means, the jaws being disengageable from the carrier of the chuck.

8 Claims, 9 Drawing Figures

14
12
19
18
2
17
3
15

31
8
2
1
4
30
7
20
21
6
5
3
9

DRIVE UNIT FOR A SEWER AUGERING MACHINE

PRIOR ART

1. German Offenlegungsschrift No. 19 36 813
2. German Offenlegungsschrift No. 19 42 341
3. U.S. Pat. No. 3,727,261
4. U.S. Pat. No. 3,246,354

Systems for cleaning pipes or the like comprise a flexible shaft or a pipe augering snake to the tip of which different tools may be attached for cleaning and removing obstructions from pipes and conduits.

The flexible shaft, during operation, is caused to rotate by a drive unit. Conventionally, this is effected by a flying three-jaw-chuck arrangement which is formed within the drive unit. Disposed in the housing of such a drive unit of the pipe cleaning apparatus are both the driving motor, normally operated electrically, and the chuck for the flexible shaft of the pipe augering snake.

A replacement of the clamping jaws can be performed only by a person skilled in the art in the workshop because a large number of parts of the system have to be first dismantled in order to obtain access to the clamping jaws. Moreover, a heavy pollution occurs through the open clamping jaw system. Important operational parts of the system are, therefore, adversely affected in function on account of the dirt deposition and corrosion formation. The life and manner of operation of the clamping jaws constituting the part of such sewer augering machines most heavily subjected to wear, can be essentially increased only by regular maintenance and cleaning. This becomes necessary because the jaws heavily contaminate during cleaning of the pipes. Accordingly, the clamping jaws, when used daily, will have to be cleaned daily because otherwise their function is considerably impaired.

It is, therefore, an object of the present invention to so form a drive unit of the aforementioned type that the clamping jaws may be removed and replaced at any time and be accomplished by an unskilled person without the aid of special tools.

This problem is solved according to the instant invention in that the chuck is disposed externally of the housing of the drive unit, and the clamping jaws are adapted to be removable from the clamping jaw carrier. A complete dismounting of the driving means of the sewer augering machine for removing the clamping jaws for cleaning purposes or replacing a new set of clamping jaws is thereby eliminated.

Feasibly, obliquely extending guide planes and grooves for guiding the clamping jaws in the clamping jaw carrier are formed in parallel on the clamping jaws. Therefore, the clamping faces of the clamping jaws are guided in parallelism to the longitudinal axis of the flexible shaft. This double guidance causes a favorable coupling between the clamping jaws and the flexible shaft. Advantageously, for guiding the clamping jaws, guiding bolts engage the guiding planes while guiding pins engage the grooves. This construction permits a simple insertion, always non-reversed, of the clamping jaws within the clamping jaw carrier.

The clamping jaws may be brought into clamping connection with the pipe augering machine flexible snake by means of push rods. Because of a freely movable construction of the push rods, a detachable clamping of the flexible shafts through the clamping jaws is provided. Helical compression springs and compressive bolts tend to yieldably hold a closing lever into the jaw opening position in order to asure freedom of movement of the push rods.

Springs with spring sleeves are formed as disengagement means in bores in the clamping jaw carrier. The spring sleeves on the one hand form a protection for the springs and on the other hand prevent the springs from breaking off.

The springs and spring sleeves, via driving pins, tend to bring the clamping jaws into their opened position. This provides a simple disengagement means for the clamping jaws.

An edge is formed at the end of each clamping jaw facing the driving means in order to prevent, upon a rotation of the chuck, the clamping jaws from being moved out because the protruding edge moves into engagement with the push rod. Despite the pressure of the push rod on the clamping jaw, and the mounting through the guiding bolts and guiding pins, the clamping jaws, on account of the high centrifugal force, would otherwise be thrown out.

It is a particularly advantageous attribute of the present invention that the chuck is adapted to be connected to one end of a hollow shaft which is rotatably disposed in the housing of the drive unit and is adapted to be driven via a gear or pulley. This provides a direct connection to the actual drive means. By passing the hollow shaft through the entire length of the driving means, and by having the connection to the chuck externally thereof, the interior of the housing of the driving means, along with the motor, remains free of dirt.

It is a further feature of the instant invention that the clamping jaws include a plurality of clamping faces disposed in parallel to their longitudinal axes and having respectively different radii of curvature. This provides the possibility of using with only one set of clamping jaws, flexible shafts of different diameters, as hereinafter set out in greater detail.

Figure 1:
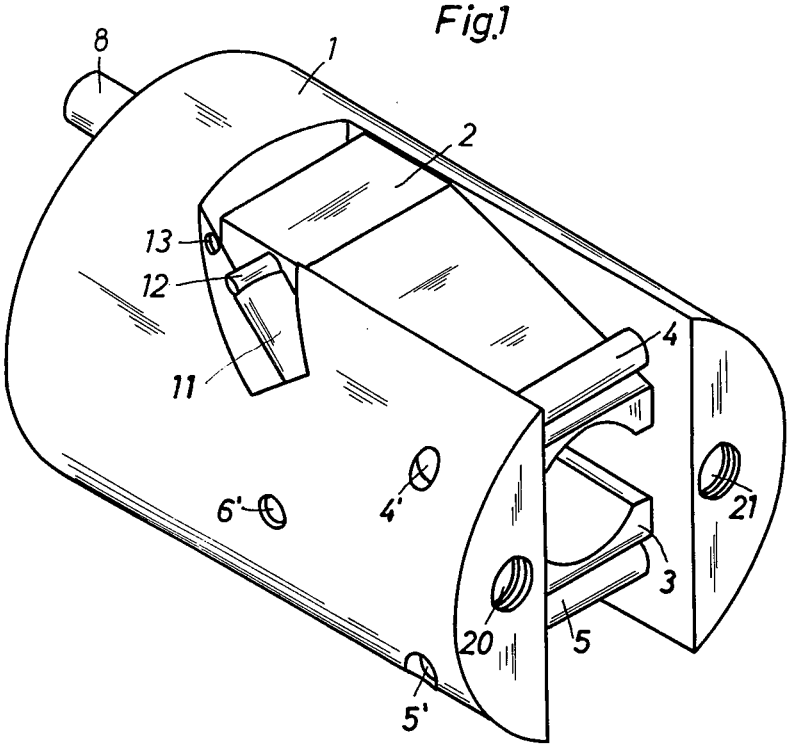
FIG. 1 is a perspective view of a chuck made according to my present invention for the flexible shaft of a sewer augering machine.
Figure 3:
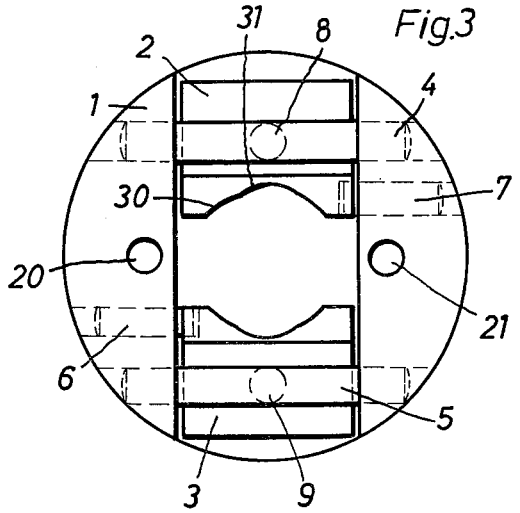
FIG. 3 is a view showing one end of the chuck opposite from the drive unit shown in FIG. 8.

FIG. 1 shows a chuck for a flexible shaft or spiral of a sewer augering machine which includes a clamping jaw carrier 1 into which clamping jaws 2 and 3 are shown inserted. Clamping jaws 2 and 3 are held in position by guiding bolts 4 and 5 (see FIG. 3). An opening in the clamping jaw carrier 1 for the bolt 7 is designated by the numeral 6' in FIG. 1. Openings for the guiding bolts 4 and 5 are designated by numerals 4' and 5' in FIG. 1.

Figure 2:
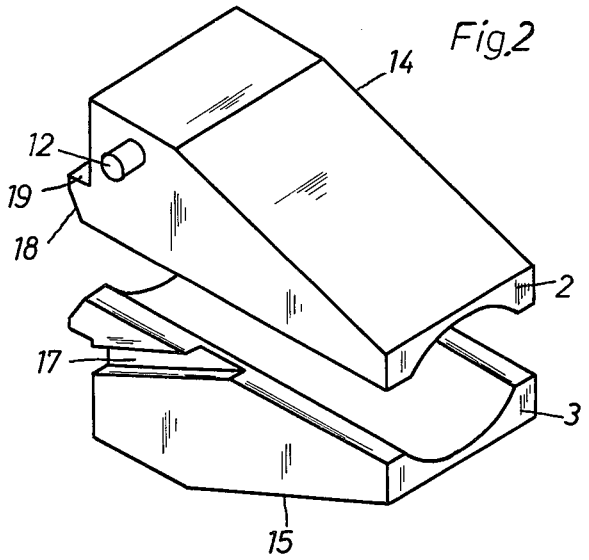
FIG. 2 is a perspective view of a pair of clamping jaws removed from the clamping jaw carrier.
Figure 4:
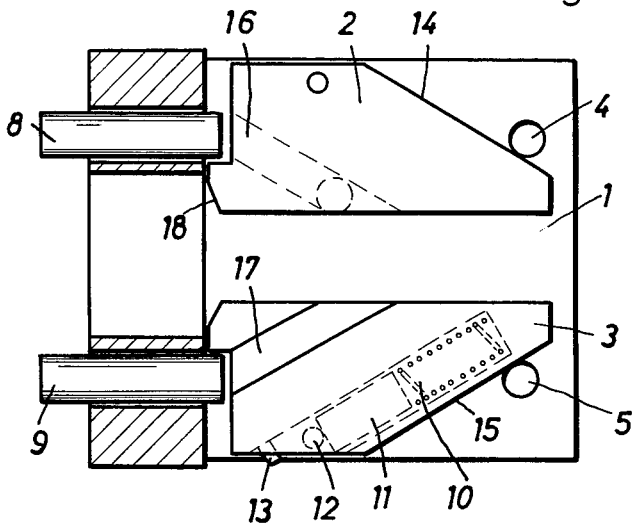
FIG. 4 is a longitudinal section through the chuck.
Figure 5:
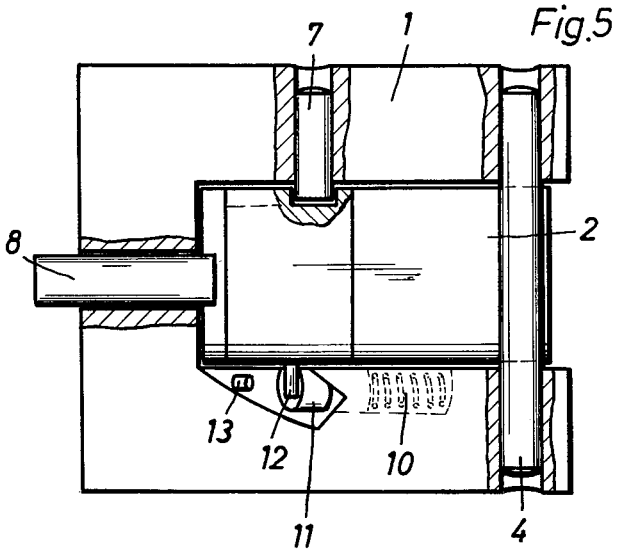
FIG. 5 is a plan view of the chuck partly broken away and in section for the sake of clearness, with the chuck turned 90° from FIG. 4.

The clamping jaws 2 and 3, which are individually illustrated in FIG. 2, are brought into clamping connection with the sewer augering machine spiral by the action of push rods 8 and 9, as is clearly shown in FIG. 4. The carrier 1 has a spring 10 and a spring sleeve 11 acting on a driving pin 12 secured to the clamping jaw 2 for yieldably biasing the latter toward its opened position.

Figure 7:
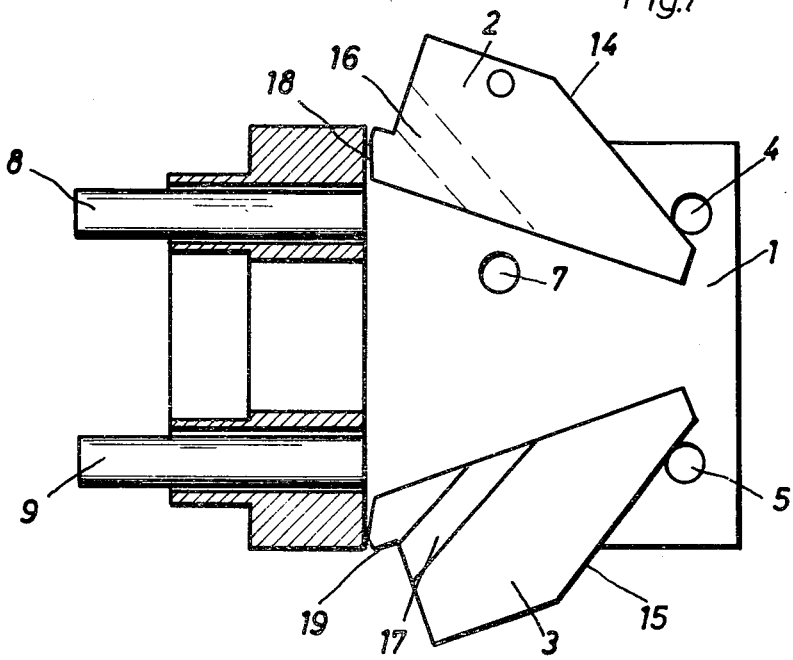
FIG. 7 is a longitudinal section similar to FIG. 4 showing the manner of insertion of the clamping jaws into the clamping jaw carrier.

Replacement of the clamping jaws 2 and 3 in accordance with FIG. 7 is performed as follows:

Clamping jaws 2 and 3 are so introduced into the clamping jaw carrier 1 that guiding planes 14 and 15 on jaws 2 and 3 respectively engage the guiding bolts 4 and 5 as grooves 16 and 17 engage the corresponding guiding pins 6 and 7. The guiding planes 14 and 15 are formed in parallelism to the grooves 16 and 17 respectively. The tapered inner ends 18 of the clamping jaws 2 and 3 are guided past the push rods 8 and 9 which cause the completely inserted clamping jaws 2 and 3 to move into locked engagement with shoulders 19 formed in jaws 2 and 3 adjacent the ends 18.

For removing the clamping jaws, the freely movable push rods 8 and 9 are pushed into the clamping jaw carrier 1 and the clamping jaws 2 and 3 are swung outwardly (FIG. 7).

Figure 8:
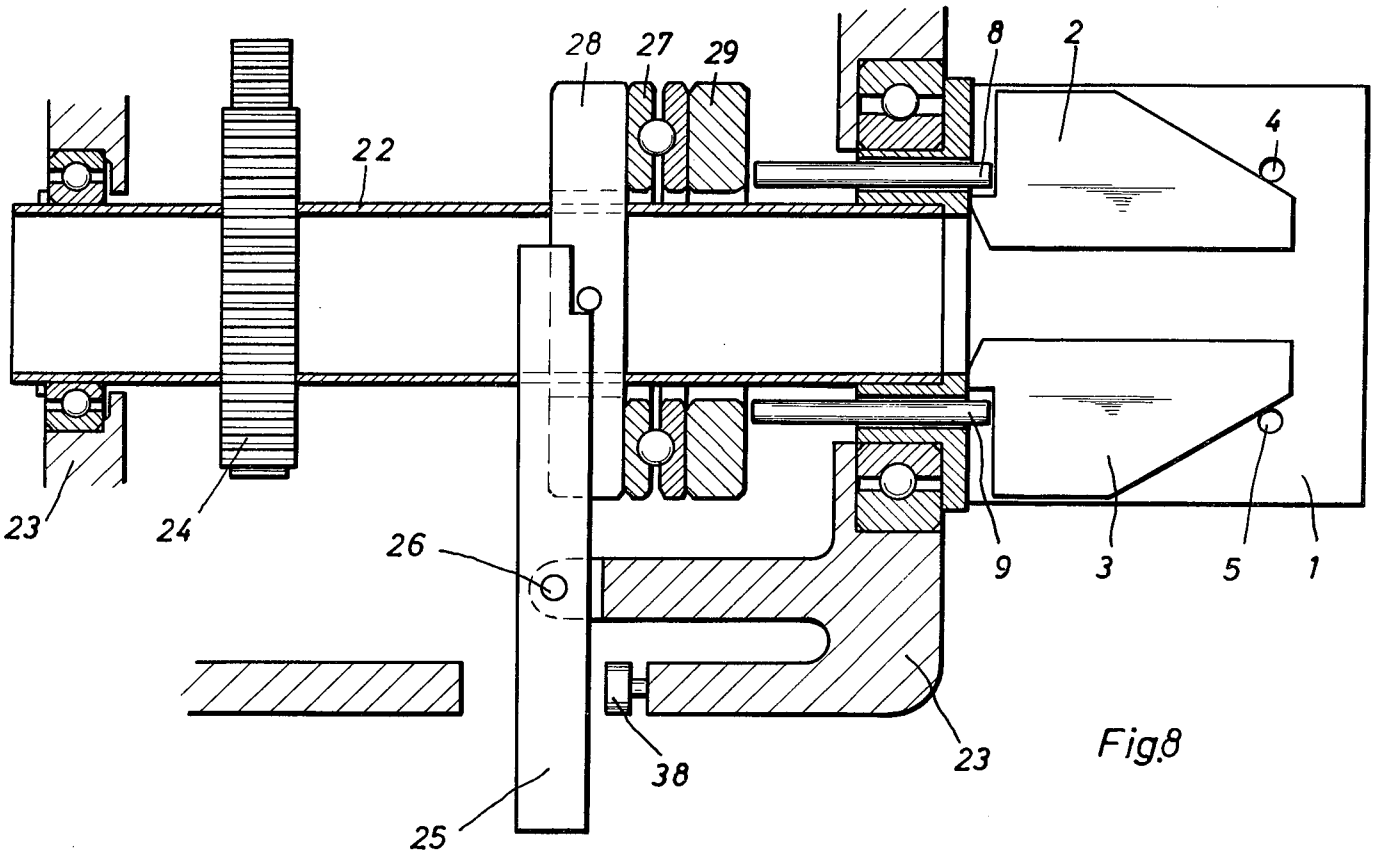
FIG. 8 is a partial longitudinal section of a drive unit made according to the present invention in which the connecting arrangement of the chuck with the drive unit is illustrated.
Figure 9:
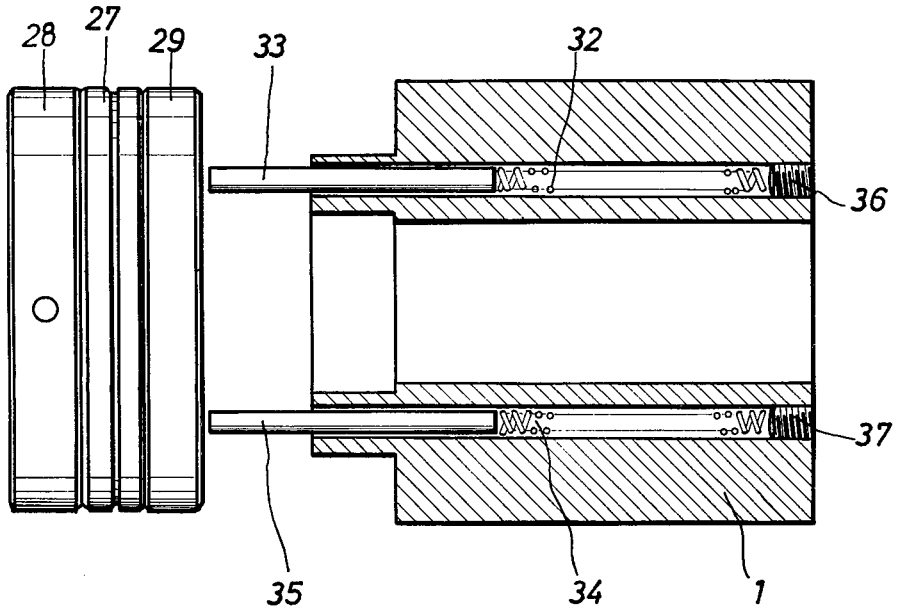
FIG. 9 is a view of a portion of the unit of FIG. 8, with a portion of the chuck in section and turned 90° from FIG. 8, showing the arrangement of the compression springs and the compression bolts.

A lever 25 (FIG. 9) for closing the jaws 2 and 3 against a flexible sewer snake is acted upon by compression springs 32 and 34 (FIG. 9) until the lever 25 engages a stop 38 (FIG. 8) carried by a housing 23. Compression springs 32 and 34 and compression bolts 33 and 35 are inserted into openings 20 and 21 (FIGS. 1 and 2) in the clamping jaw carrier 1 and are locked by screws 36 and 37 (FIG. 9).

Figure 6:
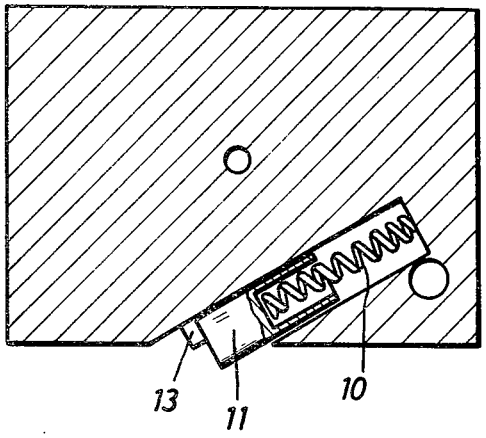
FIG. 6 is a partial longitudinal section through the clamping jaw carrier illustrating one of the jaw biasing springs.

In order to prevent the spring sleeve 11 and the spring 10 for the automatic opening of the clamping jaw 3 from being thrown out when removing the clamping jaws 2 and 3 from the clamping jaw carrier 1, the path of outward movement thereof is limited by a pin 13 mounted in carrier 1 (FIG. 6).

The chuck is connected to one end of a hollow shaft 22 (FIG. 80) which passes through the entire length of the housing 23 of the driving means. The connection between the chuck and hollow shaft 22 may be effected, for example, by adhesive screws or welding. The hollow shaft 22, through which in turn is guided the flexible snake, is rotatably disposed in the housing 23 of the drive unit and is adapted to be driven via a pulley. The pulley may be replaced by toothed gears 24, sprockets or the like.

Engagement of the clamping jaws 2 and 3 of the chuck with the flexible snake via push rods 8 and 9 is effected through the closing lever 25 which is disposed in the housing 23 and a thrust bearing 27 is interposed between a pair of thrust collars 28 and 29, all of which are movable along the shaft 22 toward and away from the carrier 1. When lever 25 is swung against the action of springs 32 and 34, collar 29 shifts the rods 8 and 9 against the jaws 2 and 3 to effect closing, thus establishing a clamping connection of the clamping jaws 2 and 3 with a flexible snake.

Advantageously, the clamping jaws 2 and 3 are comprised of a plurality of clamping faces 30 and 31 disposed in parallel to their longitudinal axes and having respectively different radii of curvature. In the form of embodiment as illustrated it is thus possible to use with one and the same drive unit two flexible shafts of different diameters, in accordance with the respective requirements. In practice, flexible shafts having diameters of 8, 16, 22, and 30 mm are used. It is thus possible to form the clamping faces of the clamping jaws 2 and 3 with four different radii of curvature extending in parallel to the longitudinal axes thereof. However, irrespective of the formation of the clamping faces with different radii of curvature, the special advantage of the present invention resides in that, depending on the respective requirements, the clamping jaws 2 and 3 may be replaced in situ without the aid of special tools or skilled people. Accordingly, in the demonstrated case of application four sets of clamping jaws 2 and 3 can be made available for the four flexible shafts of different diameters which, depending on the requirements, can be inserted into the clamping jaw carrier 1 of the drive unit.

Accordingly, the invention provides a drive unit of a sewer augering machine which is suitable for use with all flexible shaft diameters and which, by loosely and automatically closing and opening of two clamping jaws 2 and 3 disposed in a chuck externally of the housing 23 of the drive unit, permits the cleaning and rapid replacement of the clamping jaws 2 and 3 without any difficulties.

I claim:

1. In a sewer augering machine having a flexible cable, the combination of:

a drive unit provided with a rotatable, tubular shaft adapted to receive said cable; and a chuck having a tubular clamping jaw carrier secured to the shaft exteriorly of said unit in alignment with the shaft for rotation of the carrier by the shaft, said carrier being provided with a pair of jaws therewithin shiftable to and from a closed position clamped against the cable when the cable is extended from the shaft through the carrier, said carrier having releasable means for holding the jaws within the carrier, said releasable means including a push rod for each jaw respectively for shifting the jaws to said closed position, said carrier having opposed jaw access means rendering the jaws removable from the carrier while the carrier remains secured to the shaft and upon release of said releasable means.

2. The invention of claim 1, said jaws having inclined, relatively converging surfaces and inclined, relatively converging grooves, the surface of each jaw being parallel with its groove, said carrier having surface-engaging means and means within the grooves for guiding the jaws to and from said closed position.

3. The invention of claim 2, said surface-engaging means comprising guiding bolts traversing the carrier, said means within the grooves comprising opposed, inwardly extending guiding pins.

4. The invention of claim 1, actuating means for pushing said rods; and resilient means yieldably biasing the actuating means to a position rendering the rods freely movable toward and away from the jaws.

5. The invention of claim 1 wherein said carrier is provided with resilient means yieldably biasing at least one of said jaws toward an open position.

6. The invention of claim 2 wherein said carrier is provided with resilient means yieldably biasing at least one of said jaws toward an open position.

7. The invention of claim 1 wherein said jaws have means engageable with the rods for precluding movement of the jaws from within the carrier during rotation of the latter.

8. The invention of claim 1, each jaw having a plurality of arcuate, cable contacting faces parallel to the longitudinal axis of the cable, said faces having differing radii of curvature.

* * * * *